US005628415A

United States Patent [19]

Mulholland

[11] Patent Number: 5,628,415

[45] Date of Patent: May 13, 1997

[54] STORAGE RACK AND SAFETY BARS FOR USE THEREIN

[75] Inventor: Anthony G. Mulholland, Mississauga, Canada

[73] Assignee: Econo-Rack Storage Equipment Limited, Mississauga, Canada

[21] Appl. No.: 475,601

[22] Filed: Jun. 7, 1995

[51] Int. Cl.[6] ..... A47B 43/00

[52] U.S. Cl. ..... 211/189; 211/187; 211/186

[58] Field of Search ..... 211/186, 187, 211/189; 403/363, 353, 348

[56] References Cited

U.S. PATENT DOCUMENTS 3,042,221 7/1962 Rasmussen ..... 211/189
4,078,664 3/1978 McConnell ..... 211/189
4,955,490 9/1990 Schafer ..... 211/189
5,279,431 1/1994 Highsmith et al. ..... 211/189

*Primary Examiner*—Brian K. Green
*Assistant Examiner*—Curtis A. Cohen
*Attorney, Agent, or Firm*—Baker & Daniels

[57] ABSTRACT

A storage rack to support pallets and the like includes an upright frame structure having at least one pair of generally parallel, laterally spaced support beams across which a pallet or the like is to be supported. At least one transverse support member spans the support beams. Retainers act between the support beams and opposed ends of the support member and are in the form of complimentary formations on the support beams and the support member. The formations are configured such that the support member must undergo torsion to engage the formations at its opposed ends with the complimentary formations on the support beams,

20 Claims, 3 Drawing Sheets

STORAGE RACK AND SAFETY BARS FOR USE THEREIN

FIELD OF THE INVENTION

The present invention relates to storage systems and in particular to a storage rack to support pallets and the like and to safety bars for use therein.

BACKGROUND OF THE INVENTION

Storage racks for supporting pallets are well known in the art and various designs have been considered. Conventional storage racks include an upright frame structure having pairs of generally parallel, laterally spaced support beams at different elevations. Pallets to be supported on the storage racks arc placed on the storage rack via a lift truck or the like in a manner so that the pallet is supported at both ends by the two support beams in a pair. Because the pallets are usually placed on the storage rack using a lift truck, it is often difficult for the lift truck operator to determine if the pallet is properly positioned so that when lowered, it will rest on both support beams. This difficulty has resulted in pallets being placed on the storage rack improperly and falling between the support beams.

To overcome this problem, safety bars have been developed for use in such storage racks. The safety bars are placed at convenient intervals and span the support beams of the pairs. To facilitate alignment of the safety bars and inhibit lateral movement, the safety bars are provided with downwardly extending tabs at both ends that arc received in slots formed in the support beams. The safety bars provide support to a pallet placed on the support beams and prevent the pallet from falling between the support beams in the event that the pallet is improperly placed on the storage rack.

The design of the mating tabs and slots is such that the safety bar is very easily removed from the support beams and can be achieved simply by lifting the safety bar. Unfortunately, in many instances, especially when freezing between the pallet and the safety bar occurs, the safety bar is inadvertently lifted from the support beams when the pallet is removed from the storage rack.

To overcome this problem, it has been considered to place beads near the ends of the tabs to resist removal of the tabs from the slots. However, this design to inhibit inadvertent lifting of the safety bar from the support bars has still been proven to be inadequate. It has also been considered to place downwardly and outwardly extending tabs at opposed ends of the safety bar on one of its sides. With this configuration, to install the safety bar, the safety bar needs to be rotated so that the downwardly and outwardly extending tabs firstly enter into appropriate slots of the support beams and then rotated back so that the other tabs are received in the appropriate slots of the support beams. Although this design provides some resistance to inadvertent separation between the safety bar and the support beams, the safety bar is still prone to accidental removal.

Accordingly there exists a need for an improved storage rack and safety bar design. It is therefore an object of the present invention to provide a novel storage rack and safety bar for use therein.

SUMMARY OF THE INVENTION

According to one aspect of the punt invention there is provided a storage rack to support pallets and the like comprising:

an upright frame structure including at least one pair of generally parallel, laterally spaced support beams;

at least one transverse support member spanning said support beams; and retaining means acting between said support beams and opposed ends of said support member, said retaining means being in the form of complementary formations on said support beams and support member and being configured such that said support member must undergo torsional deformation to engage the formations at its opposed ends with the formations on said support beams.

According to another aspect of the present invention there is provided a storage rack to support pallets and the like comprising:

an upright frame structure including a plurality of pairs of generally parallel, laterally spaced support beams at different elevations;

a plurality of transverse safety bars spanning the support beams of each pair at various locations; and retaining means acting between the support beams and opposed ends of the safety bars, the retaining means being in the form of complementary formations on the support beams and the safety bars and being configured such that the safety bars must undergo torsion to engage the formations at its opposed ends with the formations on the support beams.

Preferably, the complementary formations are in the form of a projecting retainer adjacent opposed ends of the safety bar and slots formed in the support beams for receiving the projecting retainers, the safety bar having to undergo torsion about its longitudinal axis to insert the retainers into the slots. In one embodiment, the projecting retainers are in the form of downwardly and outwardly extending tabs. In another embodiment, the projecting retainers are in the form of hooks.

According to another aspect of the present invention there is provided a safety bar for use in a storage rack to support pallets and the like comprising:

a body having an upper surface to support pallets, and a pair of sidewalls extending downwardly from opposed edges of said upper surface; and a downwardly and outwardly extending projection adjacent each end of said body, the projections at opposite ends of said safety bar extending towards opposite sides thereof.

The present invention provides advantages in that since the transverse safety bar must undergo deformation to engage the formations at its opposite ends with the formations on the support beams and since it returns to its undeformed state once the formations are engaged, significant resistance to both lateral and vertical movement is achieved. This reduces significantly the occurrence of accidental removal of the transverse safety bars from the support beams.

BRIEF DESCRIPTION OF THE DRAWINGS

Embodiments of the present invention will now be described by way of example only with reference to the accompanying drawings in which.

DESCRIPTION OF THE PREFERRED EMBODIMENTS

Figure 1:
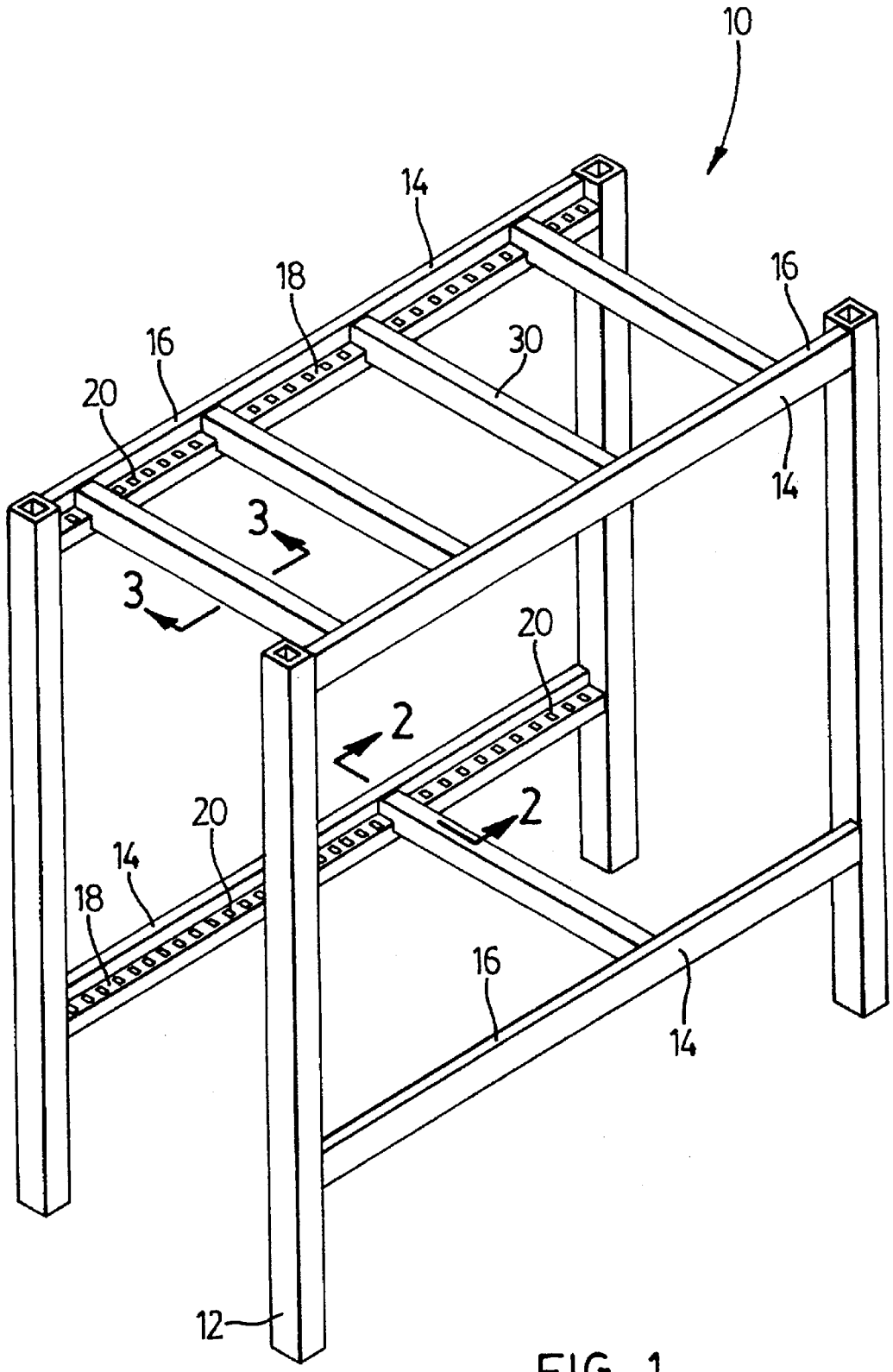
FIG. 1 is a perspective view of a storage rack in accordance with the present invention.
Figure 2:
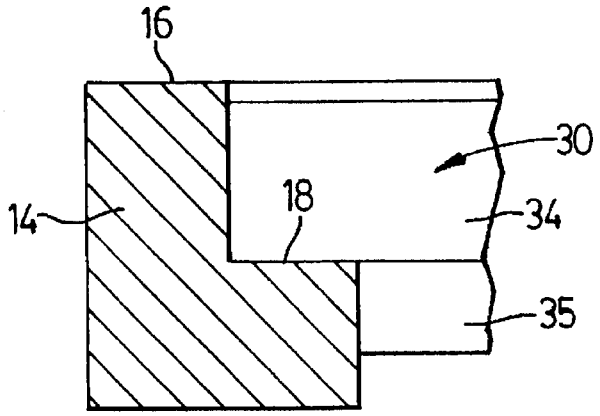
FIG. 2 is a section of the storage rack of FIG. 1 taken along line 2—2.

Referring now to FIGS. 1 and 2, a storage rack is shown and is generally indicated by reference numeral 10. As can be seen, the storage rack includes an upright frame structure 12 including a number of pairs of generally parallel, laterally spaced support beams 14 at different elevations. The support beams 14 am configured to form steps defining upper support surfaces 16 on which pallets and the like are to rest and lower support surfaces 18. A row of laterally spaced slots 20 is formed on each lower support surface 18.

Figure 3:
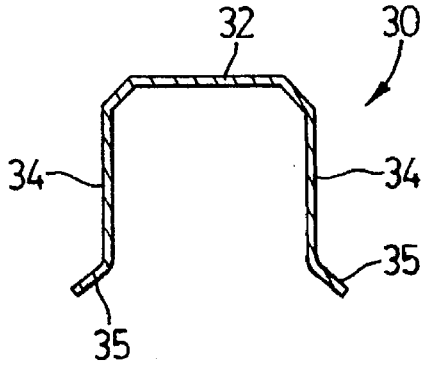
FIG. 3 is a section of the storage rack of FIG. 1 taken along line 3—3.
Figure 4:
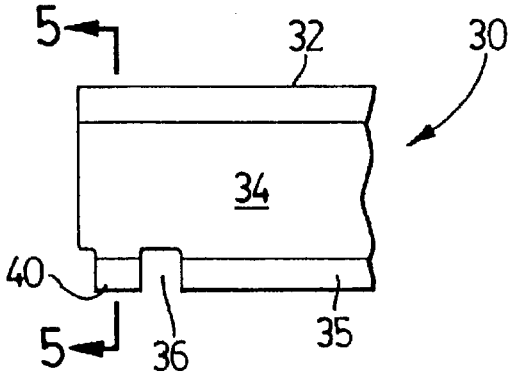
FIG. 4 is a side elevation of a safety bar forming part of the storage rack of FIG. 1.
Figure 5:
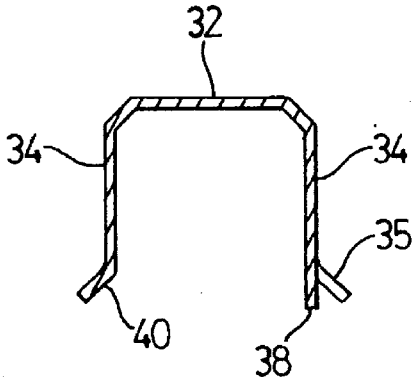
FIG. 5 is a section of the safety bar of FIG. 4 taken along line 5—5.

Spanning the support beams at spaced locations are a plurality of transverse support members 30 commonly referred to as safety bars. The safety bars 30 (best seen in FIGS. 3 to 5) are formed of steel and are configured as channel members. Each safety bar 30 has an upper surface 32 to assist in the support of a pallet and a pair of vertical sidewalls 34. The sidewalls 34 flare outwardly near their boom edges as indicated by reference numeral 35. Cut-outs 36 are located on both sidewalls 34 near their opposed ends. The cut-outs 36 define formations in the form of tabs 38 and 40 adjacent opposed ends of each sidewall (see FIG. 5). One of the tabs 38 extends downwardly (i.e. is vertical) while the other tab 40 is configured similar to the sidewall 34 and extends downwardly and outwardly. The orientation of the tabs 38 and 40 on the sidewalls 34 is such that like tabs are located at opposite ends of the safety bar 30.

To secure the safety bar 30 to the support beams 14 of a pair, the tabs 38, 40 on opposed sidewalls 34 at one end of the safety bar must firstly be engaged in appropriate slots 20 of one of the support beams. Because the tab 40 is outwardly flared, the safety bar must be rotated to insert that tab 40 in a slot 20. Once inserted, the safety bar can be rotated back to insert the downwardly extending tab 38 in a slot 20. Since an outwardly flared tab is located on the safety bar at its other end and on the side opposite the location of the tab 40 already engaged in a slot 40, the tabs 38 and 40 at that end of the safety bar will not simply fall into place within the slots 20 of the other of the support beams 14 of the pair.

In order to engage the outwardly flared tab 40 at the other end of the safety bar, it is necessary to apply torque to the safety bar 30 to deform it about its longitudinal axis to bring the end of the outwardly extending tab 40 into alignment with the slot 20. Once aligned, the tab 40 can be inserted into the slot 20. The torque placed on the safety bar necessary to align the tab with the slot can be released once the tab 40 has been inserted into the slot 20. With the torque released, the safety bar assumes its original configuration allowing the last tab 38 to fall into place in the slot 20.

Since torque must be placed on the safety bar in order to secure it to the support beams, torque must also be placed on the safety bar in order to remove it from the support beams. Therefore, the complementary tabs and slots act as retainers to keep the safety bar in place once the tabs have been properly positioned in the slots. Because of this, vertical forces placed on the safety bar will not result in its removal from the support beams unlike the conventional safety bars described previously.

Another advantage of the present safety bar is its ease of manufacture. The design of the safety bar is such that it can be roll-formed without requiring any secondary processes. Specifically, when forming the safety bar, a steel sheet is tint punched to remove pieces of the sheet to define the tabs. The sheet is then rolled to form the channel member and is then cut to yield safety ban of the desired length. Yet another advantage of the present invention is that the inter-engagement of the safety bar and the support beams is such that manufacturing tolerances of the support beams, frame structure and safety bar need not be tightly controlled to achieve reliable operation of the safety bar while maintaining its resistance to inadvertent movement due to lateral and vertical forces.

Although the safety bar has been described as having an outwardly extending tab on each of its sidewalls, it should be apparent to those of skill in the art that other retainer configurations may be used as will be described.

Figure 6:
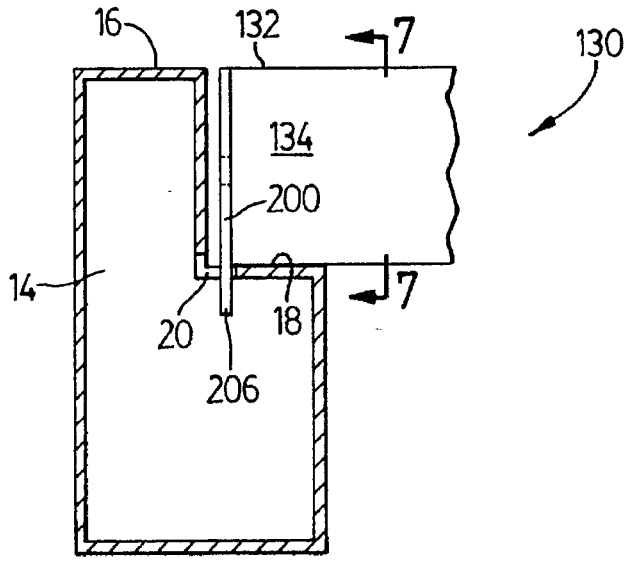
FIG. 6 is a sectional view of a storage rack including an alternative embodiment of a safety bar.
Figure 7:
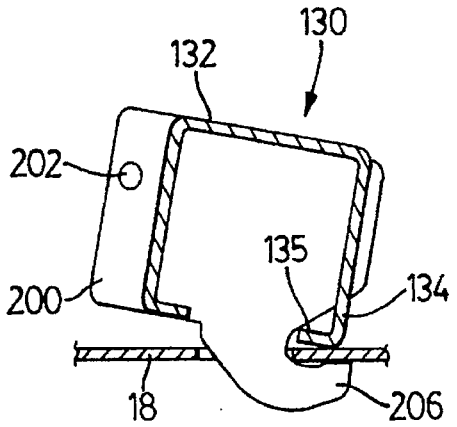
FIG. 7 is a section of FIG. 6 taken along line 7—7 and rotated.
Figure 8:
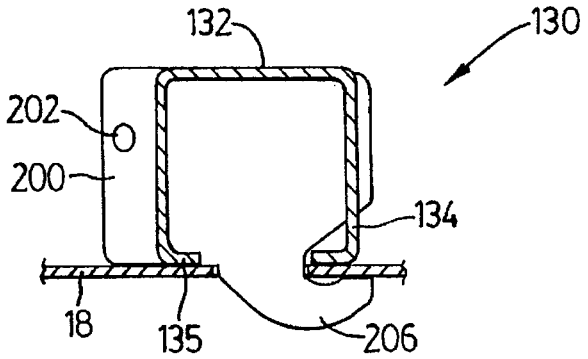
FIG. 8 is a section of FIG. 6 taken along line 7—7.

Referring now to FIGS. 6 to 8, another embodiment of a safety bar 130 is shown. In this embodiment, like reference numerals will be used to indicate like components with a "100" added for clarity. Similar to tho previous embodiment, the safety bar 130 is formed of steel and is configured as a channel member. Thus, the safety bar has an upper surface 132 and a pair of vertical sidewalls 134. Unlike the previous embodiment, the sidewalls 132 are inturned at their bottom edges as indicated by reference numeral 135.

Fastened to each end of the channel member by welds or other suitable means, is a plate 200. The plate 200 extends beyond one of the sidewalls 132 and accommodates an aperture 202. The bottom of the plate is configured to define a hook 206 which projects below the channel member and extends to one of its sides. The plates 200 at the ends of the safety bar 130 are designed such that the hooks 206 extend towards opposite sides of the safety bar.

Securing the safety bar 130 to the support beams 14 of a pair is achieved in a manner similar to that described in the previous embodiment. In particular, the hook 206 of one plate 200 must firstly be engaged in a slot 20 by rotating the safety bar 130 to align the hook 206 and the slot 20 (see FIG. 7). Once this is done, the safety bar 130 can be rotated back as shown in FIG. 8. In order to align the hook 206 of the other plate with a slot 20 in the support beam, it is necessary to apply torque to the safety bar to deform it about its longitudinal axis to bring that hook into alignment with the slot. Once aligned, the hook can be placed in the slot and the torque can be released allowing the safety bar 130 to assume its original configuration. If additional protection against rotation of the safety bar 130 is desired, a fastener such as a Tek screw can be passed through the aperture 202 and accommodated by the support beams 14.

As one will appreciate, in the above-described embodiments, it is necessary to apply toque to the safety bar in order to engage the projections at its opposed ends with the slots in the support beams.

It should aim be apparent to those of skill in the an that various modifications or variations may be made to the present invention without departing from the scope thereof as defined by the appended claims.

I claim:

1. A storage rack to support pallets comprising:

an upright frame structure including at least one pair of generally parallel, laterally spaced support beams;

at least one transverse support member spanning said support beams; and retaining means acting between said support beams and opposed ends of said at least one transverse support member, said retaining means being in the form of complementary formations on said support beams and said at least one transverse support member including co-operating slots and projections, the projections of said complementary formations extending in different directions such that said at least one transverse support member must undergo torsional deformation to align and engage the formations at its opposed ends with the formations on said support beams.

2. A storage rack as defined in claim 1 wherein said complementary formations are in the form of at least one projecting retainer on opposed sides and at opposite ends of said at least one transverse support member and slots formed in the support beams for receiving said projecting retainers.

3. A storage rack as defined in claim 2 wherein said at least one projecting retainers are in the form of downwardly and outwardly extending tabs.

4. A storage rack as defined in claim 3 wherein said tabs are integrally formed with said at least one transverse support member.

5. A storage rack as defined in claim 4 wherein each end of said at least one transverse support member has a pair of tabs, one tab of each pair positioned on an opposite side of said at least one transverse support member, one tab of each pair being downwardly and outwardly extending and the other tab of each pair being downwardly extending, the pairs of tabs at each end of said at least one transverse support member being oriented so that the like tabs of each pair are positioned on opposite sides of the at least one transverse support member.

6. A storage rack as defined in claim 1 wherein said complementary formations are in the form of hooks at opposed ends of the at least one transverse support member and slots formed in the support beams, the hooks at the ends of said support member extending in opposite directions.

7. A storage rack as defined in claim 6 wherein said hooks are mounted on plates fastened to the ends of said at least one transverse support member, said plates and support beams accommodating at least one fastener to provide additional support against rotation of said at least one transverse support member when said support member is engaged with said support beams.

8. A storage rack to support pallets comprising:

an upright frame structure including a plurality of pairs of generally parallel, laterally spaced support beams at different elevations;

a plurality of transverse safety bars spanning the support beams of each pair at laterally spaced locations; and retaining means acting between the support beams and opposed ends of the safety bars, the retaining means being in the form of complementary formations on the support beams and the safety bars including cooperating slots and projections, the projections of said complementary formations extending in different directions such that the safety bars must undergo torsion to align and engage the formations at its opposed ends with the formations on the support beams.

9. A storage rack as defined in claim 8 wherein the complementary formations are in the form of at least one downwardly and outwardly extending tab on opposite sides and positioned at opposite ends of said safety bars and slots in the support beams for receiving the tabs, the safety bars having to undergo torsion to align and insert the tabs at their opposed ends into the slots.

10. A storage rack as defined in claim 9 wherein said tabs are integrally formed with said safety bars.

11. A storage rack as defined in claim 10 wherein the ends of each safety bar have a pair of tabs, one tab of each pair being positioned on an opposite side of said safety bar, one tab of each pair being downwardly and outwardly extending and the other tab of each pair being downwardly extending, the pairs of tabs at the ends of the safety bars being oriented so that like tabs of the pairs are positioned on opposite sides of the safety bar.

12. A storage rack as defined in claim 8 wherein said complementary formations are in the form of hooks at opposed ends of each of said safety bars and slots formed in the support beams, the hooks at each end of each of said safety bars extending towards an opposite side thereof.

13. A storage rack as defined in claim 12 wherein said hooks are mounted on plates fastened to the ends of said safety bars, said plates and support beams accommodating at least one fastener to provide additional support against rotation of said safety bars when said safety bars are engaged with said support beams.

14. A storage rack for supporting pallets comprising:

a framework defined by a plurality of generally vertical uprights and pairs of generally horizontal support beams; and a plurality of laterally spaced safety bars spanning said support beams of each pair, said safety bars and support beams carrying complementary formations including co-operating slots and projections to said bars to said support beams, the projections adjacent opposed ends of said safety bars extending in different directions such that said safety bars must undergo torsion to align and engage said complementary formations.

15. A storage rack as defined in claim 14 wherein said projections are carried by said safety bars.

16. A storage rack as defined in claim 15 wherein said projections are in the form of downwardly and outwardly extending slots.

17. A storage rack as defined in claim 14 wherein said projections are in the form of hooks.

18. A storage rack for supporting pallets comprising:

a framework defined by a plurality of generally vertical uprights and pairs of generally horizontal support beams; each support beam having a series of spaced slots formed therein; and a plurality of laterally spaced safety bars spanning said support beams of each pair, each safety bar having a projection adjacent each end thereof to engage a slot in a support beam to retain said safety bar to said support beams, the projections at the ends of each safety bar extending in different directions such that said safety bar must undergo torsion to align and engage said projections in said slots.

19. A storage rack as defined in claim 18 wherein said projections are in the form of downwardly and outwardly extending tabs adjacent opposed ends and on opposite sides of said safety bars.

20. A storage rack as defined in claim 19 wherein said projections are in the form of hooks at the ends of said safety bars.

* * * * *